US009004556B2

(12) United States Patent
Gaibler et al.

(10) Patent No.: US 9,004,556 B2
(45) Date of Patent: Apr. 14, 2015

(54) MASTER COUPLING LINK AND ASSEMBLY

(75) Inventors: Dennis Gaibler, Wilsonville, OR (US); Michael A. Hall, Jefferson, LA (US)

(73) Assignees: The Ulven Companies, Hubbard, OR (US); Michael A. Hall, Jefferson, LA (US)

( * ) Notice: Subject to any disclaimer, the term of this patent is extended or adjusted under 35 U.S.C. 154(b) by 0 days.

(21) Appl. No.: 13/698,277

(22) PCT Filed: May 19, 2011

(86) PCT No.: PCT/US2011/037127

§ 371 (c)(1), (2), (4) Date: Jan. 30, 2013

(87) PCT Pub. No.: WO2011/146702

PCT Pub. Date: Nov. 24, 2011

(65) Prior Publication Data

US 2013/0134725 A1 May 30, 2013

Related U.S. Application Data

(60) Provisional application No. 61/346,128, filed on May 19, 2010.

(51) Int. Cl.
*B66C 1/00* (2006.01)
*B66C 3/12* (2006.01)
(Continued)

(52) U.S. Cl.
CPC ... *B66C 1/14* (2013.01); *B66C 1/12* (2013.01); *B21L 5/00* (2013.01)

(58) Field of Classification Search
CPC ..... B66C 1/34; B66C 1/18; B66C 1/12; B66C 1/14; B66C 1/125; F16G 11/14; F16G 13/14; F16G 13/12; F16G 15/04; F16G 13/06; F16G 15/00; F16G 17/00; F16M 13/00; F16M 13/02; F21V 21/38; E04B 9/18; E04B 9/006; A01K 1/04; A01K 27/003; A01K 27/005; A01K 15/02; A63B 69/0079; B60C 27/08; B60C 27/10
USPC ..... 294/66.1, 74, 82.11, 82.1, 82.12, 82.17; 248/320, 317; 119/769, 786, 788, 791; 224/579, 580, 609, 611; 59/93, 90, 84, 59/78; 24/116 R
See application file for complete search history.

(56) References Cited

U.S. PATENT DOCUMENTS 1,713,901 A * 5/1929 Hanson ..... 24/129 B
2,703,476 A * 3/1955 Donaldson ..... 59/93
(Continued)

FOREIGN PATENT DOCUMENTS

EP 1232991 8/2002
JP 57-196079 12/1982
(Continued)

OTHER PUBLICATIONS

International Search Report for PCT/US2011/037127 (mailed Jan. 12, 2012).

*Primary Examiner* — Stephen Vu
(74) *Attorney, Agent, or Firm* — Klarquist Sparkman, LLP

(57) ABSTRACT

A master coupling link assembly comprises a master coupling link and at least one sub-coupling link. The master coupling link has a first eye dimensioned to receive a lifting hook and at least two second eyes separated from the first eye. The at least one sub-coupling link is coupled to the master coupling link at one of the at least two second eyes, and the sub-coupling link is formed with the master coupling link.

18 Claims, 6 Drawing Sheets

(51) Int. Cl.

| | |
|---|---|
| ***B66C 1/14*** | (2006.01) |
| ***B66C 1/12*** | (2006.01) |
| ***B21L 5/00*** | (2006.01) |

(56) References Cited

U.S. PATENT DOCUMENTS

| | | | | |
|---|---|---|---|---|
| 4,068,467 | A | | 1/1978 | Schreyer et al. |
| 4,248,469 | A | | 2/1981 | Knox |
| 4,941,698 | A | * | 7/1990 | Klibert et al. ..... 294/82.12 |
| 5,836,631 | A | * | 11/1998 | Coe ..... 294/74 |
| 6,604,769 | B2 | * | 8/2003 | Herman et al. ..... 294/82.12 |
| 6,948,752 | B1 | * | 9/2005 | Crow ..... 294/82.11 |
| 2011/0175383 | A1 | * | 7/2011 | Segura ..... 294/82.1 |

FOREIGN PATENT DOCUMENTS

| | | |
|---|---|---|
| JP | 62-013985 | 1/1987 |
| JP | 03-023191 | 1/1991 |

* cited by examiner

MASTER COUPLING LINK AND ASSEMBLY

CROSS REFERENCE TO RELATED APPLICATION

This is the U.S. National Stage of International Application No. PCT/US2011/037127, filed May 19, 2011, which was published in English under PCT Article 21(2), which in turn claims the benefit of U.S. Provisional Application No. 61/346,128, filed on May 19, 2010, which is incorporated herein in its entirety.

FIELD

This application relates to rigging, and in particular to new a master coupling link and related assembly used in the lifting of heavy objects, such as with a crane or other lifting device.

BACKGROUND

Master links or master coupling links are typically a single connection point to which a crane or hoist hook can be attached. Conveniently, master coupling links allow for slings, chains or other forms of tension elements extending to various locations on a load to be coupled together in a way that permits a wide range of adjustment for each such element. U.S. Pat. No. 4,068,467 discloses one such master link.

Master links are subject to great loads and stresses. In addition, master links are used in environments where providing for speeding rigging and de-rigging is advantageous. Conventionally available master coupling links do not provide a sufficiently robust yet flexible solution.

SUMMARY

Described below are embodiments of a master coupling link and assembly that address the problems of the prior art.

According to some embodiments, a master coupling link assembly comprises a master coupling link and at least one sub-coupling link. The master coupling link has a first eye dimensioned to receive a lifting hook and at least two second eyes separated from said first eye. The at least one sub-coupling link is coupled to the master link at one of the at least two second eyes. The sub-coupling link is formed with the master coupling link.

The at least one sub-coupling link can comprise a primary eye and at least one secondary eye separate from the primary eye. The sub-coupling link can be coupled to the master coupling link by the intersection of the primary eye of the sub-coupling link and the first eye of the master coupling link.

The sub-coupling link can comprise two secondary eyes. The sub-coupling link can be coupled to the master coupling link without welding.

The master coupling link can be formed by casting. The sub-coupling link can be formed by casting or forging. The master coupling link and the sub-coupling link can each be formed without welds.

The at least one sub-coupling link can have tri-lobed shaped periphery. The at least one sub-coupling link can have at least a portion with an I-beam shaped cross-section. The at least one sub-coupling link can have rounded contact surfaces.

The master coupling link can have a curved surface with a first radius and the sub-coupling link can have a mating surface with a radius substantially the same as the first radius. The first eye and the at least one second eye can be dimensioned relative to each other to avoid point loading when the first eye and the second eye contact each other.

The assembly can comprise an electronically readable identification device attached to the assembly. At least the master coupling link can be made of a cast steel comprising 0.16-0.23% carbon, 0-0.80% silicon, 0-0.40% sulfur, 1.4-2.0% nickel, 0.04-0.12% vanadium, 0.70-1.00% manganese, 0-0.40% phosphorus, 0.30-0.45% chromium and 0.035-0.080% aluminum, with the balance being iron.

According to a method, a master coupling link assembly is formed by forming a master coupling link having a first eye dimensioned to receive a lifting hook and at least two second eyes separated from the first eye, and forming at least one sub-coupling link having at least one primary eye. The forming of a master coupling link and the forming of at least one sub-coupling link can take place in their recited order, opposite their recited order or approximately simultaneously. The master coupling link and the sub-coupling link are coupled together following the two forming acts.

DETAILED DESCRIPTION

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and subcombinations with one another. The methods, apparatus, and systems are not limited to any specific aspect or feature or combination thereof, nor do the disclosed embodiments require that any one or more specific advantages be present or problems be solved.

The use of the terms "a" and "an" and "the" and similar referents in the context of describing the embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of protection unless otherwise claimed. No language in the specification should be construed as indicating any non-claimed element as essential to the practice of the invention.

Figure 1:
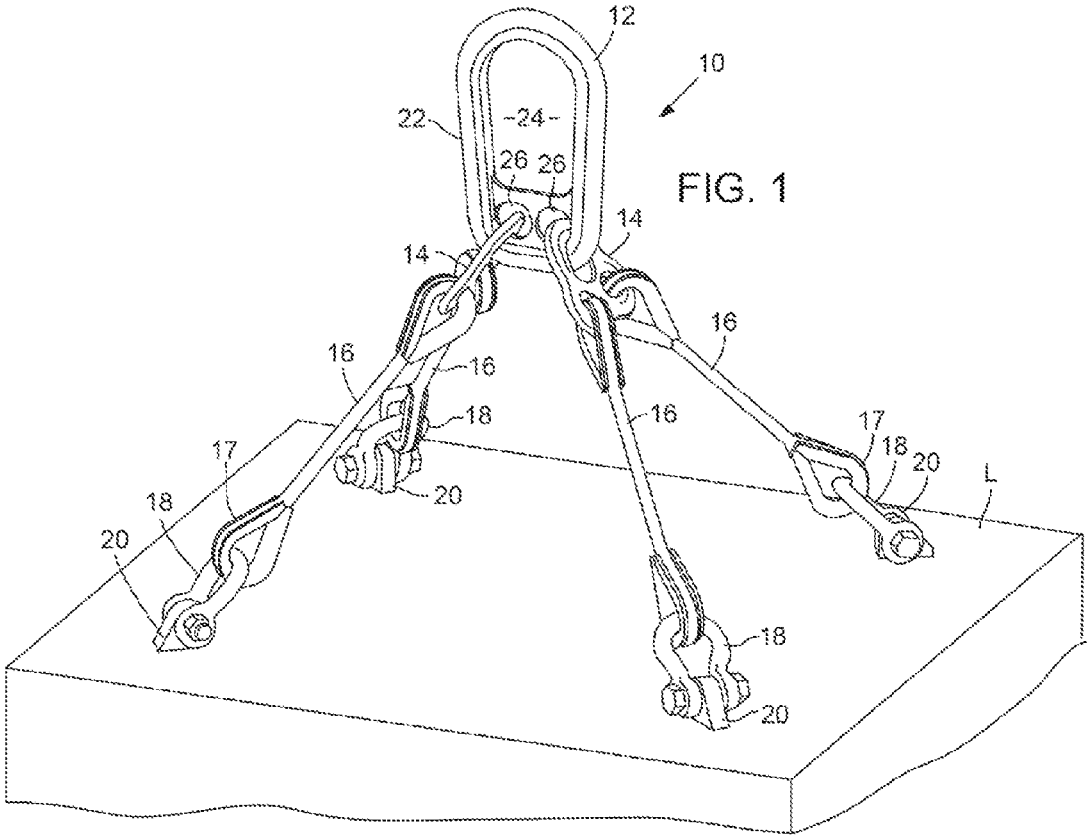
FIG. 1 is a perspective view of a master coupling link assembly as configured for use by a hook to lift the illustrated load.
Figure 2:
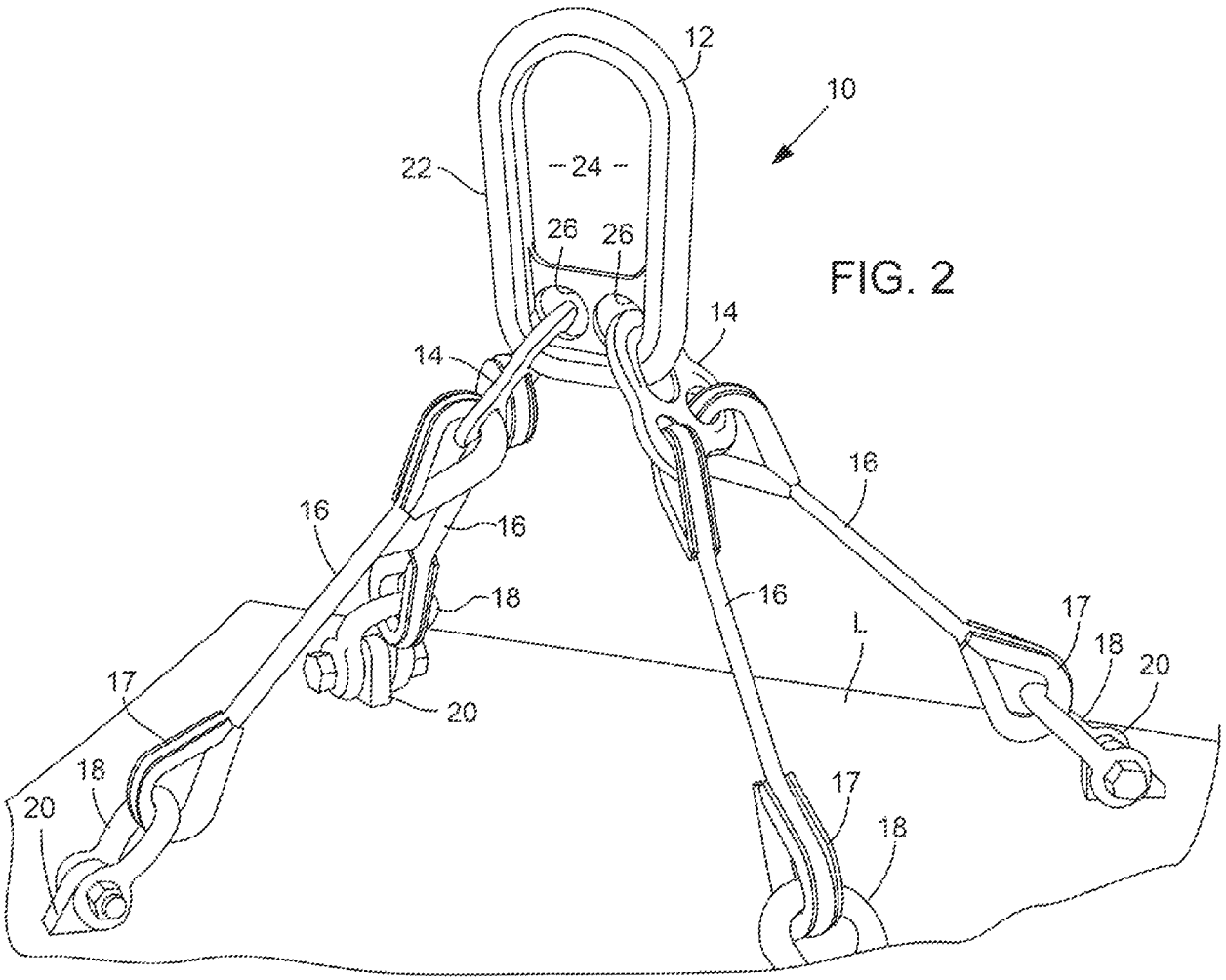
FIG. 2 is an enlarged perspective view of the assembly of FIG. 1 showing a master coupling link and two sub-coupling links.

In FIG. 1, a new master coupling link assembly 10 is shown as configured for receiving a lifting hook (such as, e.g., a hook of a crane) to allow for lifting a load L. Specifically, the master coupling link assembly 10 comprises a master coupling link 12 and one or more sub-coupling links coupled to the master coupling link 12, with two such sub-coupling links 14 being shown in the drawing.

Each sub-coupling link 14 is in turn coupleable to another object, such as to an upper end of one or more cable slings 16. In FIG. 1, the upper ends of two such slings 16 are coupled to one of the two sub-coupling links 14, making for a total of four slings 16. Each of the slings is coupled to a shackle 18, which is in turn connected to an eye 20 attached to the load L. The load L may be a shipping container as shown, or any other appropriate load.

The master coupling link 12 has a body 22 that defines an opening or major eye 24, such as for a hook of a crane, and at least one minor eye 26 for the one or more sub-coupling links 14. In the illustrated implementation, there are two minor eyes 26, and each receives one of the two sub-coupling links 14.

Figure 3:
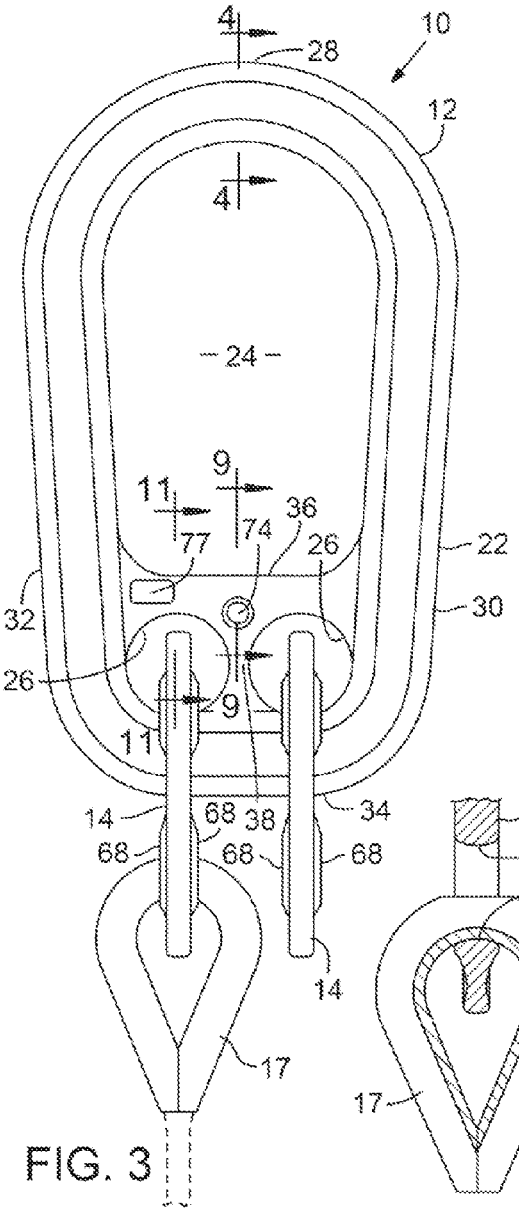
FIG. 3 is a front view of the master coupling link assembly of FIG. 1, except showing only one thimble attached to one of the sub-coupling links.

As best shown in FIG. 3, the master coupling link 12 has a rounded top portion 28 and sides 30, 32 that slope gradually inward in the direction of a bottom portion 34, which is generally straight with rounded corners. The rounded top portion 28 may be semicircular, such as is shown in the illustrated embodiment. The body 22 comprises a web 36 that extends across the major eye 24, and a web 38 that extends along a longitudinal axis from the web 36 to the bottom portion 34. The webs 36 and 38, together with the body 22, define the major eye 24 and the minor eyes 26.

Figure 4:
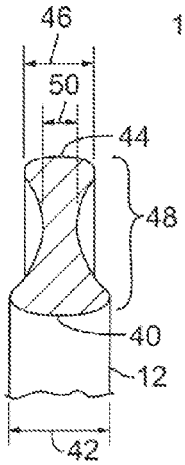
FIG. 4 is a section view taken at D-D in FIG. 3 and showing a cross section of the master coupling link.

As shown in FIG. 4, the master coupling link 12 can have a generally I-beam shaped cross section, with an inner side 40 having an increased dimension 42 in the width direction, an outer side 44 having a dimension 46 and an intermediate portion 48 between the inner side 40 and the outer side 44 having a reduced dimension 50. One or more of the outer side 44, the inner side 40, and the intermediate portion 48 may have rounded surfaces as illustrated. Such rounded surfaces help reduce the possibility of point loading and provide for more even load distribution.

Figure 5:
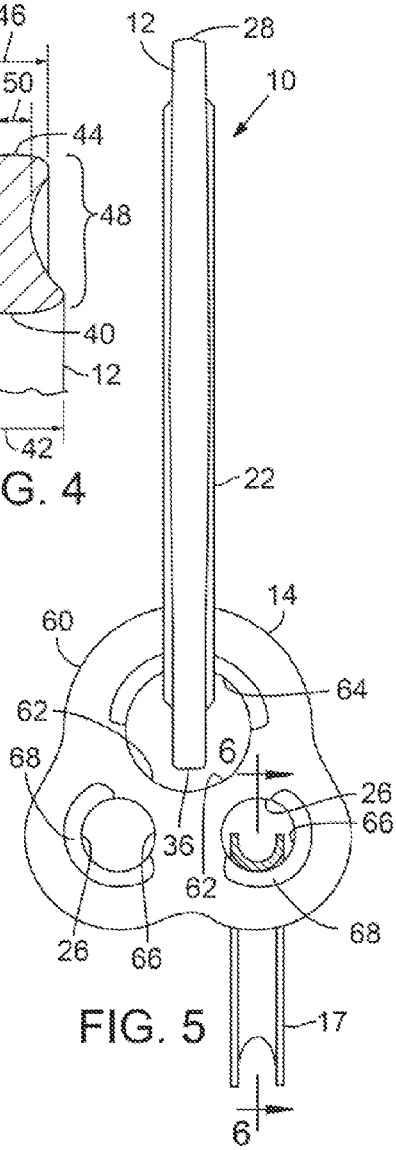
FIG. 5 is a side view of the master coupling link assembly of FIG. 3.

As shown in FIG. 5, each of the sub-coupling links 14 may have a body 60 and interior webs 62 defining a primary eye 64 and one or more secondary eyes 66. Preferably, the master coupling link 12 and the sub-coupling link 14 are formed by a process that does not require either component to be welded or fastened closed to join it to the other component. Rather, one component is formed in coupled condition relative to the other component.

For example, in the illustrated embodiment, two sub-coupling links 14 can be formed first, such as by casting or forging, and then inserted into a suitable mold for casting the master link 12. The forming of the master coupling link 12 can then be carried out such that it is formed having each of its two minor eyes 26 coupled to a respective one the two sub-coupling links 14. For example, a no-bake casting or other suitable molding process can be used. Other equivalent forming methods and sequences could be used. It would be possible, of course, to form the master coupling link 12 first and then form the sub-coupling links 14 in coupled condition relative to the master coupling link. Because the master coupling link 12 and the sub-coupling link 14 preferably do not have welds or other types of junctions or seams, they inherently have greater strength, integrity, and reliability. For example, the reliability of the assembly is not dependent on the quality of a weld in the master link 12 and/or in sub-coupling links 14 and/or skill of a welder.

The primary eye 64 is dimensioned to allow the sub-coupling link 14 to be engaged with one of the eyes 26 of the master coupling link 12, yet to move freely relative to the master coupling link 12 without binding. Similarly, each of the secondary eyes 66 is dimensioned to allow the sub-coupling link 14 to be engaged with another object, such as a sling 16, yet to allow free movement without binding. By comparing FIG. 1, which shows the assembly 10 under load, and FIG. 7, which shows the assembly 10 at rest and not under load, it can be seen that the sub-coupling link 14 is freely movable relative to the master coupling link 12. It can also be seen that the secondary eyes 66 can be dimensioned to have relatively narrow areas sized to receive a thimble 17 at an upper end of the sling, which assists in keeping the slings separated from each other, keeping the slings extending along intended directions for lifting, and otherwise avoiding interference with other components and/or kinking.

Figure 6:
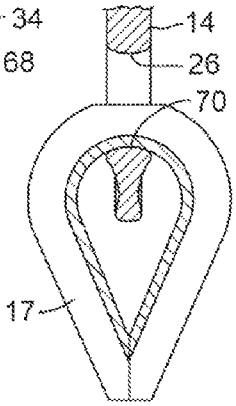
FIG. 6 is a section view taken at G-G in FIG. 5 and showing a section of the sub-coupling link and coupled thimble.

Similar to the master coupling link 12, the sub-coupling link 14 is preferably formed to have an I-beam shaped cross section as shown in FIG. 6 in areas 68 where the body 60 contacts other components. For example, the body 60 is formed with an inner surface 70 having an increased dimension in the thickness direction at an upper end of the primary eye 64 and at a lower, outer portion of each secondary eye 66. The sub-coupling link 14 can have a tri-lobed peripheral shape as shown to provide strength where necessary yet minimize overall weight.

Figure 11:
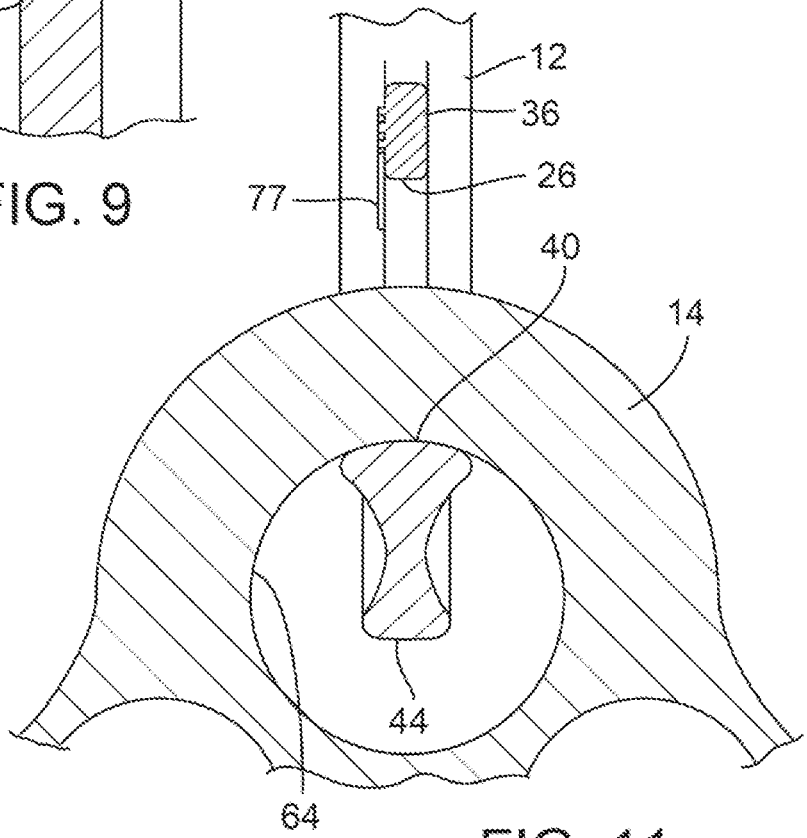
FIG. 11 is a section view taken at L-L in FIG. 3 and showing a section of master coupling link and one of the sub-coupling links in contact with each other.

Preferably, the master coupling link 12 and the sub-coupling link 14 have complimentary cross sections in at least one position. Referring to FIG. 11, the primary eye 64 of the sub-coupling link 14 can be dimensioned to compliment the curved inner side 40 of the master coupling link 12. For example, the respective radii of the primary eye 64 and the curved inner side 40 can have the same dimension or vary by only a small degree. In this way, the contact between the master coupling link 12 and the sub-coupling link(s) while loaded occurs along substantially all of the contact surface, and the disadvantages of point loading are avoided. The resulting low compressive stress levels lead to lower wear rates, which in turn allow for longer product life.

Figure 7:
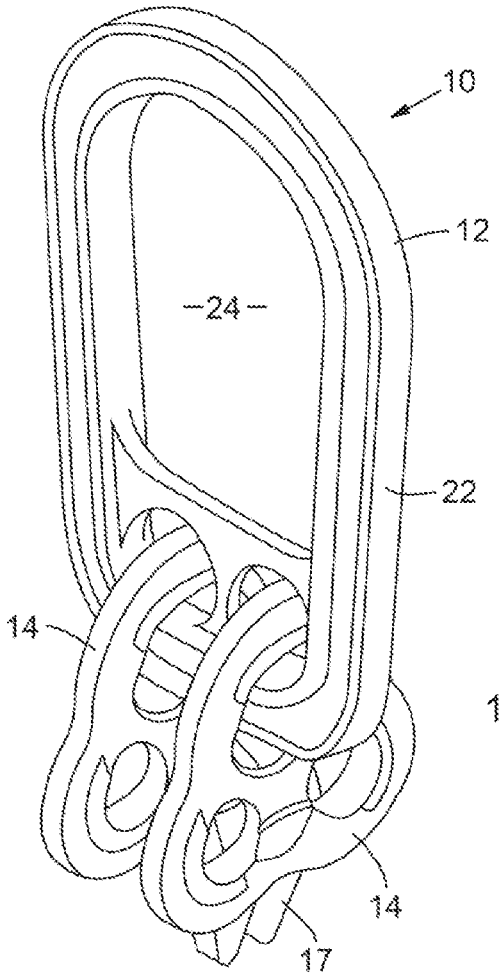
FIG. 7 is a perspective view of the coupling link assembly of FIG. 3, showing the assembly in at rest position from a front side of the coupling link.

As shown in FIGS. 3, 5 and 7, the secondary eye 66 is dimensioned as necessary to allow free movement of a coupled rigging component, such as a conventional thimble 72 at an upper end of a sling.

Figure 8:
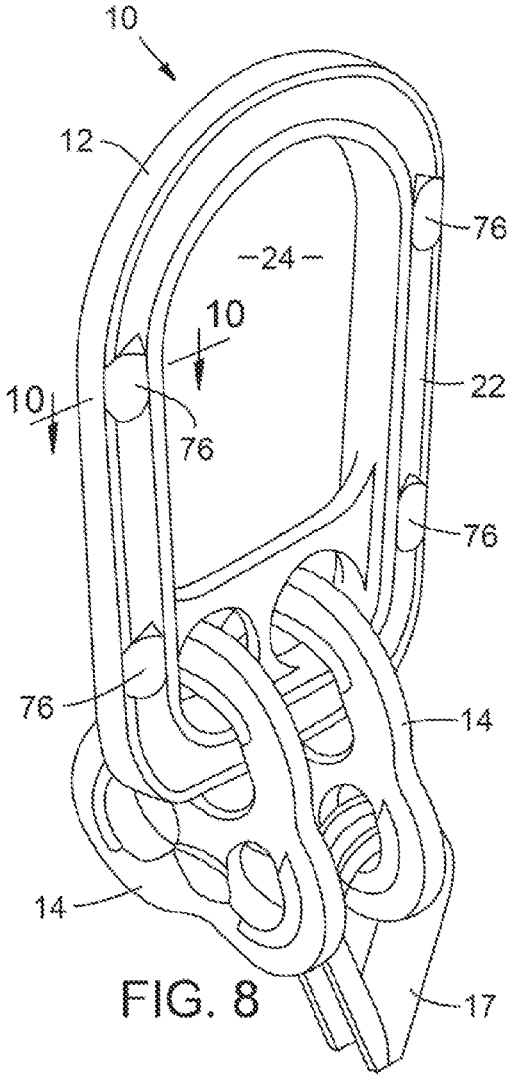
FIG. 8 is a perspective view of the coupling link assembly of FIG. 3, showing the assembly in at rest position from a rear side of the coupling link.

As shown in FIG. 3, the master coupling link 12, or another part of the assembly, can be fitted with an RFID tag 74 or other electronic identification device to allow individual master coupling links to be identified. For example, the RFID tag 74 can be read to provide instructions as to how the master coupling link 12 may be safely used. In addition, the RFID tag 74 can provide information on, e.g., the origin, date of manufacture (age) and/or service history of the assembly 10. The RFID tag 74 can be positioned on the assembly 10 at any suitable location, such along the web 36 as shown in FIGS. 8 and 11. Two sources of suitable RFID tags are Holland 1916 of North Kansas City, Mo., and Infor of Alpharetta, Ga.

Figure 9:
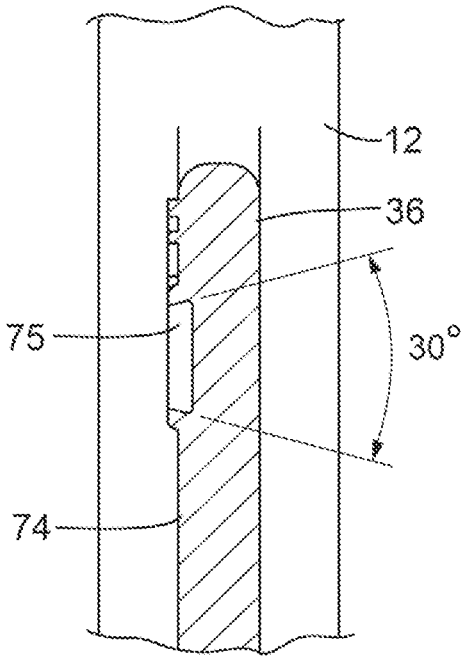
FIG. 9 is a section view taken at H-H in FIG. 3 and showing a section of the master coupling link.

For example, the RFID tag 74 can be set in a recess 75 as best shown in FIG. 9. If desired, the recess can have a reverse draft to help retain the RFID in place. For example, the recess 75 of FIG. 9 can be cone-shaped with a reverse draft angle of 30 degrees (i.e., a 15 degree taper). The RFID tag 74 can be covered with epoxy to help retain it within the recess 75. The epoxy also makes the location of the RFID tag 74 easier to visualize.

As best shown in FIG. 3, the master coupling link 12 or another part of the assembly can have a serialization pad 77 on which a serial number or other identifying information can be placed.

Figure 10:
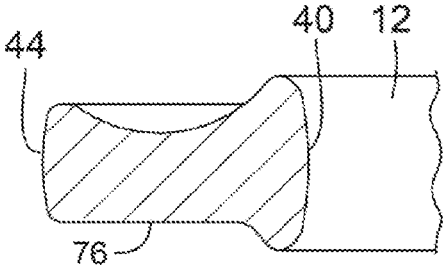
FIG. 10 is a section view taken at J-J in FIG. 8 and showing a section of the master coupling link at flat portions on a rear side of master coupling link.

As shown in FIG. 8, in some embodiments, the body 22 has one or more flat areas 76 that interrupt the generally I-beam shaped cross section, which can be seen by comparing the section view of FIG. 10 to the section view of FIG. 4. Specifically, FIG. 8 shows that in one embodiment, there are four flat areas 76, and they are located on the rear side. The flat areas 76 are at the locations of the gates and risers used to feed molten material into the mold, after any remaining material that protruded from the body has been removed.

Figure 12:
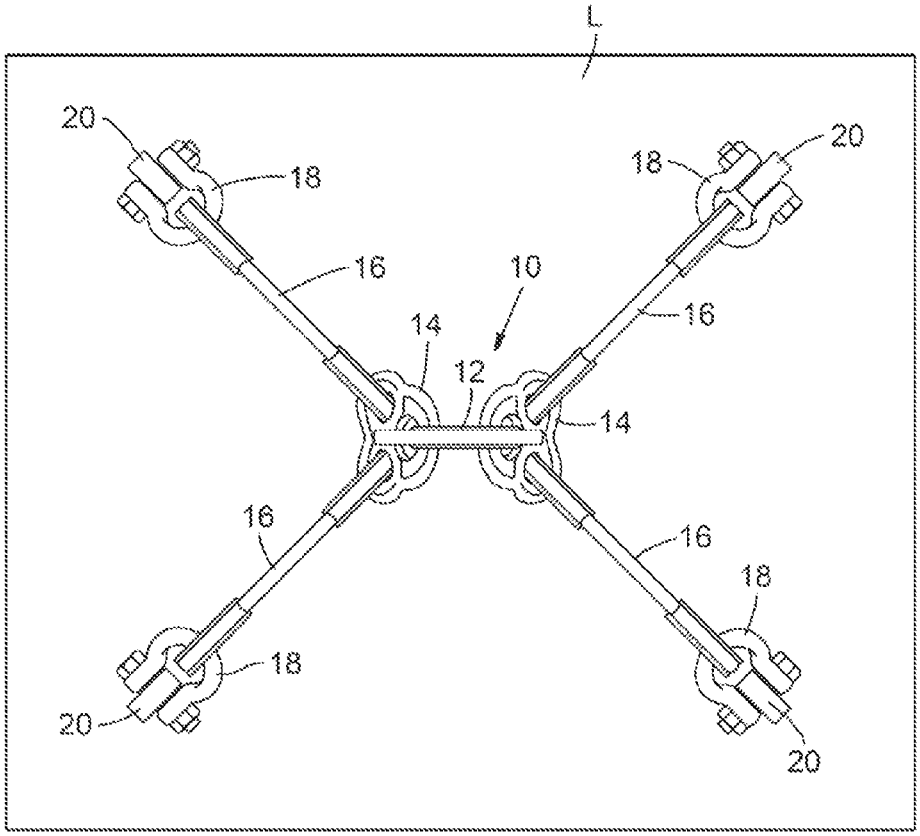
FIG. 12 is a top plan view of the master coupling link assembly of FIG. 1.

FIG. 12 is a top plan view of the assembly as configured in FIG. 1, showing how the two sub-coupling links 14 allow for proper separation of the slings 16, and that the master coupling link 12 in turn allows for proper separation of the sub-coupling links 14, such that each of the couplings between the components allows for appropriate loading and binding is avoided.

Although the assembly can be formed of any suitable material, one preferred material is cast steel. In some embodiments, the cast steel comprises 0.16-0.23% carbon, up to 0.80% silicon, up to 0.40% sulfur, 1.4-2.0% nickel, 0.04-0.12% vanadium, 0.70-1.00% manganese, up to 0.40% phosphorus, 0.30-0.45% chromium, and 0.035-0.080% aluminum, with the balance being iron. Such a cast steel has good yield and tensile strengths, ductility and toughness, even at low temperatures. The components can be subjected to a heat treating process, during which the cast components are normalized, austentized and quenched, and water quenched from tempering temperature. The resulting hardness is preferably in the range of 277-293 BHN.

In view of the many possible embodiments to which the disclosed principles may be applied, it should be recognized that the illustrated embodiments are only preferred examples and should not be taken as limiting in scope.

We claim:

1. A master coupling link assembly, comprising:

a master coupling link having a first eye dimensioned to receive a lifting hook and at least two second eyes separated from said first eye;

at least one sub-coupling link having a body defining a primary eye and extending through one of the second eyes of the master coupling link, the primary eye of the sub-coupling link intersecting said one of the second eyes of the master coupling link to movably couple the sub-coupling link and the master coupling link together.

2. The master coupling link assembly of claim 1, wherein the body of the sub-coupling link defines at least one secondary eye separate from the primary eye.

3. The master coupling link assembly of claim 1, wherein the sub-coupling link comprises two secondary eyes.

4. The master coupling link assembly of claim 1, wherein the body of the sub-coupling link defining the primary eye, and the coupling of the sub-coupling link and the master coupling link together is weldless.

5. The master coupling link assembly of claim 1, wherein the master coupling link is cast.

6. The master coupling link assembly of claim 1, wherein the sub-coupling link is cast or forged.

7. The master coupling link assembly of claim 1, wherein a body of the master coupling link defining the first eye and the body of the sub-coupling link defining the primary eye are weldless.

8. The master coupling link assembly of claim 1, wherein the at least one sub-coupling link has a tri-lobed shaped periphery.

9. The master coupling link assembly of claim 1, wherein the at least one sub-coupling link has an I-beam shaped cross-section around at least a portion of the secondary eye.

10. The master coupling link assembly of claim 1, wherein the at least one sub-coupling link has rounded contact surfaces.

11. The master coupling link assembly of claim 1, wherein the one of the second eyes of the master coupling link has a curved surface with a first radius defining at least a portion of an inner periphery, and the primary eye of the sub-coupling link has a mating surface with a radius substantially the same as the first radius defining at least a portion of an inner periphery.

12. The master coupling link assembly of claim 1, wherein the primary eye and the at least one second eye are dimensioned relative to each other to avoid point loading when the first eye and the second eye contact each other.

13. The master coupling link assembly of claim 1, further comprising an electronically readable identification device attached to the assembly.

14. The master coupling link assembly of claim 1, wherein at least the master coupling link is made of a cast steel comprising 0.16-0.23% carbon, 0-0.80% silicon, 0-0.40% sulfur, 1.4-2.0% nickel, 0.04-0.12% vanadium, 0.70-1.00% manganese, 0-0.40% phosphorus, 0.30-0.45% chromium and 0.035-0.080% aluminum, and a balance of iron.

15. The master coupling link assembly of claim 1, wherein the master coupling link has a body with an I-beam shaped cross-section around at least a portion of the first eye.

16. A master coupling link assembly, comprising:

a master coupling link having a first eye dimensioned to receive a lifting hook and at least two second eyes separated from said first eye;

first and second sub-coupling links each having a body defining a primary eye and extending through a respective one of the second eyes of the master coupling link, the primary eye of each sub-coupling link intersecting said respective one of the second eyes of the master coupling link to movably and independently couple each sub-coupling link and the master coupling link together.

17. The master coupling link assembly of claim 16, wherein the at least two second eyes are positioned approximately equidistant from the first eye.

18. The master coupling link assembly of claim 16, wherein the master coupling link has a longitudinal axis passing through the first eye, and wherein the second eyes are aligned on an axis perpendicular to the longitudinal axis.

* * * * *